US008713874B2

(12) United States Patent
Bingham

(10) Patent No.: US 8,713,874 B2
(45) Date of Patent: May 6, 2014

(54) WALL RESTORATION SYSTEM AND METHOD

(75) Inventor: Charles Bingham, Macomb, MI (US)

(73) Assignee: Action Extraction, Inc., Macomb, MI (US)

( * ) Notice: Subject to any disclaimer, the term of this patent is extended or adjusted under 35 U.S.C. 154(b) by 1002 days.

(21) Appl. No.: 12/796,123

(22) Filed: Jun. 8, 2010

(65) Prior Publication Data

US 2010/0307100 A1 Dec. 9, 2010

Related U.S. Application Data

(60) Provisional application No. 61/184,980, filed on Jun. 8, 2009.

(51) Int. Cl.
*E04B 1/70* (2006.01)

(52) U.S. Cl.
USPC ..... 52/302.3; 454/341; 34/105

(58) Field of Classification Search
USPC ..... 454/341; 34/103, 105; 52/302.1, 302.3
See application file for complete search history.

(56) References Cited

U.S. PATENT DOCUMENTS

| | | | | |
|---|---|---|---|---|
| 5,155,924 | A | 10/1992 | Smith | |
| 5,419,059 | A | 5/1995 | Guasch | |
| 5,555,643 | A | 9/1996 | Guasch | |
| 5,893,216 | A | 4/1999 | Smith et al. | |
| 6,393,724 | B1 * | 5/2002 | Apple et al. | 34/232 |
| 6,652,628 | B1 | 11/2003 | Hess | |
| 6,691,427 | B1 | 2/2004 | Fernandes et al. | |
| 7,022,167 | B2 | 4/2006 | Hess | |
| 7,247,090 | B2 * | 7/2007 | Vacek | 454/186 |
| 7,284,384 | B2 | 10/2007 | Hess | |
| 7,284,385 | B2 | 10/2007 | Hess | |
| 7,284,386 | B2 | 10/2007 | Hess | |
| 7,284,387 | B2 | 10/2007 | Hess | |
| 2005/0076781 | A1 | 4/2005 | Hess | |
| 2005/0257394 | A1 | 11/2005 | Claesson | |
| 2006/0053817 | A1 | 3/2006 | Hess | |
| 2006/0060183 | A1 | 3/2006 | Hess | |
| 2006/0064891 | A1 | 3/2006 | Hess | |
| 2007/0051007 | A1 | 3/2007 | Reets et al. | |
| 2011/0219714 | A1 * | 9/2011 | Martin | 52/302.1 |

FOREIGN PATENT DOCUMENTS

| | | | |
|---|---|---|---|
| DE | 3815161 | A1 | 11/1989 |
| EP | 0490073 | A1 | 6/1992 |
| GB | 2242017 | A | 9/1991 |
| SE | 502635 | C2 | 11/1995 |
| WO | 9423142 | A1 | 10/1994 |

* cited by examiner

*Primary Examiner* — John K Fristoe, Jr.
*Assistant Examiner* — Ian Paquette
(74) *Attorney, Agent, or Firm* — Reising Ethington P.C.

(57) ABSTRACT

One illustrative embodiment of a wall restoration system includes an air-handler and a wall structure assembly. The wall structure assembly can enclose a portion of a wet wall to form a passage through which air flows to dry the wall portion.

10 Claims, 3 Drawing Sheets

FIG. 4
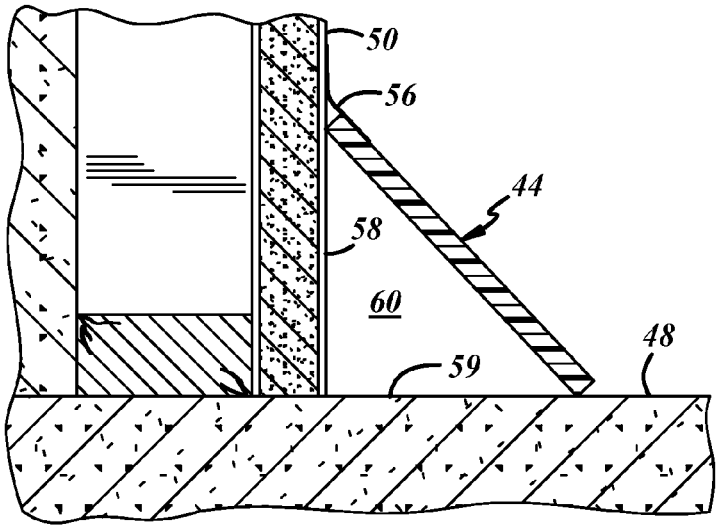
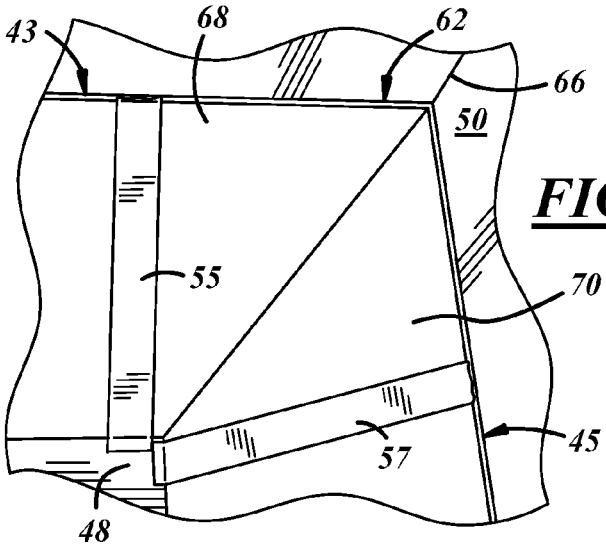
FIG. 5
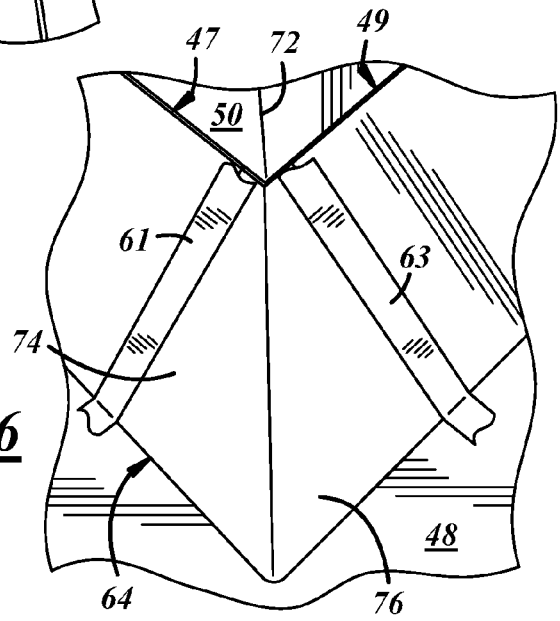
FIG. 6

WALL RESTORATION SYSTEM AND METHOD

This application claims the benefit of U.S. Provisional Application Ser. No. 61/184,980 filed Jun. 8, 2009.

TECHNICAL FIELD

The technical field generally relates to ways to restore wet walls.

BACKGROUND

Occasionally, a residential or commercial basement or other floor may flood after a heavy rain, plumbing malfunction, or other cause. The walls can become wet and, if unserviced, can sometimes become permanently damaged. Conventionally, a so-called vortex drying process is used to dry the walls. The vortex drying process typically involves subjecting the entire room to forced air movement via numerous air-movers. Among other things, this process is noisy, energy-intensive, uncontrolled, requires a relatively lengthy drying period, and is largely inefficient.

SUMMARY OF SELECT EMBODIMENTS OF THE INVENTION

One embodiment may include a product which may include an air-handler, a supply duct, and a wall structure assembly. The air-handler may have an outlet and may provide forced-air movement through the outlet. The supply duct may communicate with the outlet and may receive force-air movement therefrom. The wall structure assembly may communicate with the supply duct and may include a panel structure. The panel structure may enclose a portion of an outer surface a wall over a horizontal length of the wall, and may enclose a portion of a floor near the wall over a horizontal length of the floor. The panel structure may form a passage for forced-air movement over the horizontal lengths of the wall and the floor.

One embodiment may include a product which may include an air-handler, a ductwork assembly, a first wall structure assembly, and a second wall structure assembly. The air-handler may have an outlet and may be constructed and arranged to provide forced-air movement through the outlet. The ductwork assembly may be constructed and arranged to communicate with the air-handler and to receive the forced-air movement. The ductwork assembly may include at least a first duct and a second duct. The first wall structure assembly may be constructed and arranged to enclose a portion of a first wall and to enclose a portion of a first floor in order to form a first passage. The first passage may be constructed and arranged to communicate with the first duct and to receive the forced-air movement from the first duct. The second wall structure assembly may be constructed and arranged to be located away from the first wall structure assembly. The second wall structure assembly may be constructed and arranged to enclose a portion of a second wall and to enclose a portion of a second floor in order to form a second passage. The second passage may be constructed and arranged to communicate with the second duct and to receive the forced-air movement from the second duct.

One embodiment may include a method which may include providing a wall structure assembly. The wall structure assembly may include a panel structure having a lengthwise dimension and a widthwise dimension. The lengthwise dimension may have a greater value than the widthwise dimension. The method may also include locating the panel structure against an outer surface of a wall and against a floor in order to form a passage between the outer surface, the floor, and the panel structure. The lengthwise dimension may be generally parallel to a horizontal direction of the wall. The method may further include providing forced-air movement through the passage in order to at least partially dry a portion of the wall and a portion of the floor that is subjected to the forced-air movement.

One embodiment may include a product which may include a wall structure assembly. The wall structure assembly may be constructed and arranged to enclose a portion of an outer surface of a wall and a portion of a floor adjacent the wall in order to at least partially dry the portions of the wall and of the floor. The wall structure assembly may include a panel structure, an inside corner structure, and an outside corner structure.

Other embodiments of the invention will become apparent from the detailed description provided hereinafter. It should be understood that the detailed description and specific examples, while disclosing illustrative embodiments of the invention, are intended for purposes of illustration only and are not intended to limit the scope of the invention

BRIEF DESCRIPTION OF THE DRAWINGS

Illustrative embodiments of the present invention will become more fully understood from the detailed description and the accompanying drawings, wherein:

FIG. 4 is a cross-sectional view of an illustrative embodiment of a wall structure assembly taken at arrows 4-4 in FIG. 3.

FIG. 5 is a perspective view of an illustrative embodiment of an inside corner structure that may be used in the wall restoration system of FIG. 1.

FIG. 6 is a perspective view of an illustrative embodiment of an outside corner structure that may be used in the wall restoration system of FIG. 1.

DETAILED DESCRIPTION OF ILLUSTRATIVE EMBODIMENTS

The following description of the embodiment(s) is merely illustrative in nature and is in no way intended to limit the invention, its application, or uses.

The figures illustrate an illustrative embodiment of a wall restoration system 10 and related method that may be used to dry wet walls to restore and thus prevent permanent damage to the walls, and help prevent potential human-health-risks associated with the presence of microorganisms. The wall restoration system 10 may be a controlled energy system that targets the wall and floor portions without unnecessarily subjecting the entire associated room to service. In one embodiment, the wall restoration system 10 may concentrate energy only to the wall and floor portions and may be adaptable to carry air through and around doorways, corners, staircases, and the like. In some cases this may provide a more efficient and quicker wall drying process as compared to other processes including the conventional vortex drying process. Though described in the context of a residential basement, the wall restoration system 10 may be used in other areas and rooms such as in commercial buildings, and the like.

Figure 1:
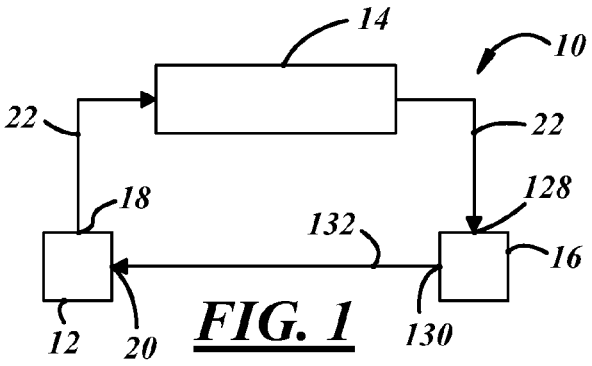
FIG. 1 is a schematic of an illustrative embodiment of a wall restoration system.

Referring to FIG. 1, in the illustrated embodiment the wall restoration system 10 may include an air-handler 12, a wall structure assembly 14, and a dehumidifier 16.

The air-handler 12 may cause forced-air movement through the wall restoration system 10. In one embodiment, the air-handler 12 may be a heater. The heater may have a supply or air outlet 18, and may have an intake or air inlet 20. In one example, the heater may be a Phoenix FireBird electric heater sold by Therma-Stor LLC of Madison, Wis., U.S.A. (www.thermastor.com). In this example, the heater may have a built-in blower that moves about 360 CFM of air and may heat the outgoing air to a temperature of about 100°-140° F. which may kill some germs when making contact therewith. In one embodiment, the outlet 18 and the inlet 20 may each be a 12 inch diameter cylinder constructed to connect to a similarly sized duct. In use, the passing and heated airflow may draw moisture out of the wet wall and floor portions, and the moisture may be carried downstream with the airflow. Also, heat may radiate through the wall and floor portions beyond the wall structure assembly 14 to dry the internal portions thereat; for example, heat may radiate vertically up the wall beyond the wall structure assembly and may radiate laterally within the interior of the wall to substrates, insulation, and other structures located therein. Of course, other heaters of different types, constructions, specifications, performances, and manufacturers are possible.

In another embodiment, the air-handler 12 may be an air-blower. The air-blower may too have the outlet 18 and the inlet 20. In one embodiment, the air-blower may move about 800 CFM of air; of course, in other embodiments the air-blower may move at different rates. In use, fast-moving and passing airflow may draw moisture out of the wet wall and floor portions, and the moisture may be carried downstream with the airflow.

Figure 2:
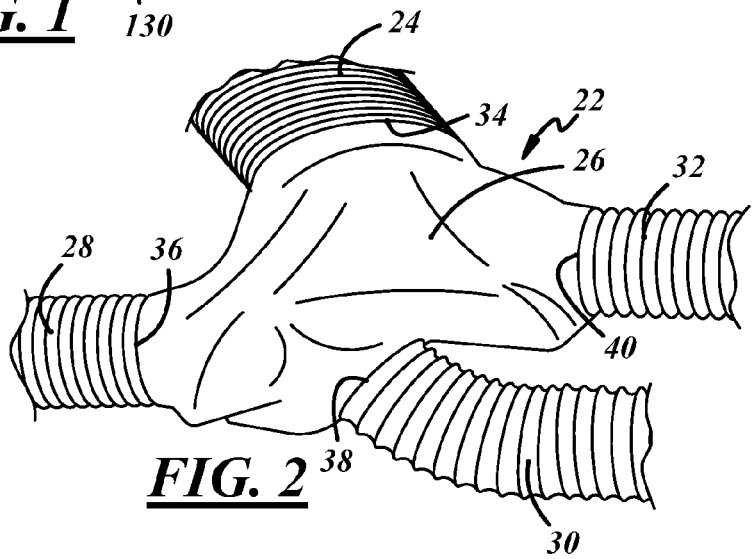
FIG. 2 is a perspective view of an illustrative embodiment of a supply manifold that may be used in the wall restoration system of FIG. 1.

Referring to FIGS. 1 and 2, air exits the outlet 18 of the air-handler 12 into a ductwork assembly 22. In general, the ductwork assembly 22 distributes and carries air to and from different components of the wall restoration system 10, and may include multiple flexible duct pieces, each may be made of flexible plastic stretched over a metal wire coil, may be made of aluminum, or may be made of another suitable material. The flexible duct pieces typically come in 6 and 12 inch diameter sizes. Of course, other ductwork structures and sizes are possible. Also, various suitable fittings may be located between the duct pieces and other components and/or structures. In the illustrated embodiment, the ductwork assembly 22 may include a supply duct 24, a supply manifold 26, and a first, second, and third duct 28, 30, 32. The supply duct 24 may be directly connected to the outlet 18 and may directly communicate with the outlet. In one embodiment, the supply duct 24 may have a 12 inch diameter. At its other end, the supply duct 24 may be directly connected to an inlet 34 of the supply manifold 26, and may directly communicate with the supply manifold.

In one embodiment, the supply manifold 26 may divert and distribute incoming air from the supply duct 24 evenly or mostly evenly to the first, second, and third ducts 28, 30, 32. The supply manifold 26 may be made of a canvas such as a product named "Aqualon Marine Canvas" provided by Great Lakes Fabrics, Inc. of Bay City, Mich. 48706, U.S.A. (www.glfi.com), or another suitable material, and may include a first, second, and third outlet 36, 38, 40 respectively directly connected to and communicating with the first, second, and third ducts 28, 30, 32. In one embodiment, the first, second, and third ducts 28, 30, 32 may have 6 inch diameters. Each of the first, second, and third ducts 28, 30, 32 may lead to a separate and distinct wall structure assembly, as will be subsequently described.

Figure 3:
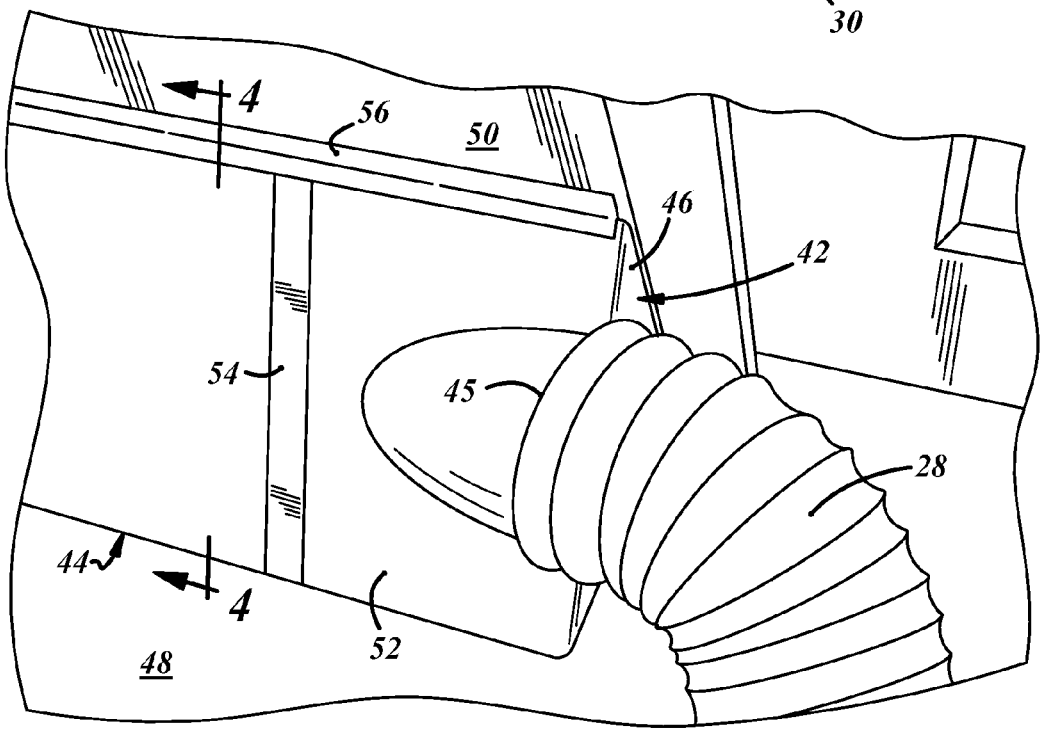
FIG. 3 is a perspective view of an illustrative embodiment of an inlet structure that may be used in the wall restoration system of FIG. 1.

The wall structure assembly 14, also called a grid system, may enclose a portion of the wet wall and floor, and may guide air along the extent of the portions while directly exposing the portions to the guided air. The wall structure assembly 14 may isolate the portion of the wet wall and floor, and may isolate the forced and pressurized airflow from the associated ambient space. The wall structure assembly 14 may include multiple pre-made separate and distinct pieces used to guide the air substantially uninterrupted through and around structures commonly found in residential basements and commercial spaces such as closets, corners, doorways, staircases, and the like. In one embodiment, the different pieces may be molded into one-piece out of ABS plastic, and may be ¼ inch thick throughout; of course other materials and thicknesses are possible. Depending on the need, the pieces may be constructed and dimensioned to enclose, for example, a 4 inch, 12 inch, or 24 inch base portion of the wet wall (measured from associated floor and vertically up). Referring to FIGS. 3 and 4, the wall structure assembly 14 may include an inlet structure 42 and a panel structure 44.

In one example, the inlet structure 42 may have an inlet opening 45 directly communicating with the first duct 28, or with the second or third ducts 30, 32. In one embodiment, the inlet structure 42 may also have a sidewall 46 contacting a floor 48 of a residential basement and contacting a wall 50 of the residential basement. The sidewall 46 may help support the connection between the inlet opening 45 and the first duct 28, and may prevent air that enters the inlet opening 45 from exiting the wall structure assembly 14. A top wall 52 of the inlet structure 42 may form an angle of about 45° with respect to the floor 48, and may too contact the floor and wall 50. The end of the inlet structure 42 located opposite the side wall 46 may remain open so that air can travel to the panel structure 44. A seal such as a first piece 54 of painter's tape may be placed over a seam formed between the inlet structure 42 and the panel structure 44. A second piece 56 of painter's tape may also be placed over a seam formed between an edge of the inlet structure 42 and the wall 50, and formed between an edge of the panel structure 44 and the wall. The pieces 54, 56 of painter's tape may help form a seal to prevent escape of air, and moisture, and may help hold the wall structure assembly 14 together and to the wall 50. Though not shown, an H-channel may be fitted between the confronting edges of the inlet structure 42 and the panel structure 44 (beneath piece 54) to join the structures together. As will be known to skilled artisans, an H-channel may be a plastic structure that resembles an "H" in cross-sectional profile and that may receive the confronting edges in its respective u-shaped recesses. In other embodiments, the seal may be a rubber flap extending from the top wall 52, for example, or may be a sealing structure such as a mating tongue and groove located at confronting edges of the inlet structure 42 and the panel structure 44.

In one embodiment, the panel structure 44 may be an elongated rectangular piece that may be 4, 8, or 16 feet in its longest dimension (i.e., its horizontal length dimension); of course other lengths are possible, and multiple individual panel structures may be abutted against one another or overlapped to create a structure of any length (regardless of the length of any one individual panel structure). The panel structure 44 may rest against and contact the floor 48 and the wall 50, and may form an angle of about 45° with respect to the floor. As best shown in FIG. 4, the panel structure 44 may enclose a wall portion 58 and a floor portion 59 that each may contain moisture. The panel structure 44 may partly form a passage 60 through which air travels during use of the wall restoration system 10; the passage 60 may be a non-divided, individual, and single space defined between the wall portion 58, the floor portion 59, and the panel structure itself.

Referring to FIGS. 5 and 6, the wall structure assembly 14 may also include an inside corner structure 62 and an outside corner structure 64. The inside corner structure 62 may bridge separate panel structures 43, 45 (both may be similar to panel structure 44) and may form the passage 60 with an inside corner 66 of the wall 50 in order to carry air around the inside corner. The inside corner structure 62 may have a first planar wall 68 and a second planar wall 70 that are angled with respect to each other. The inside corner structure 62 may rest against and may contact the floor 48 and the wall 50 at the inside corner 66. In one embodiment, a pair of H-channels may be fitted between the confronting edges of the inside corner structure 62 and the panel structures 43, 45, and seals such as pieces 55, 57 of painter's tape may be placed over seams thereat. Though not shown, seals may also be placed over a seam formed between edges of the inside corner structure 62 and the wall 50.

The outside corner structure 64 may bridge separate panel structures 47, 49 (both may be similar to panel structure 44) and may form the passage 60 with an outside corner 72 of the wall 50 in order to carry air around the outside corner. The outside corner structure 64 may have a first planar wall 74 and a second planar wall 76 that are angled with respect to each other. The outside corner structure 64 may rest against and may contact the floor 48 and the wall 50 at the outside corner 72. In one embodiment, a pair of H-channels may be fitted between the confronting edges of the outside corner structure 64 and the panel structures 47, 49, and seals such as pieces 61, 63 of painter's tape may be placed over seams thereat. Though not shown, seals may also be placed over a seam formed between edges of the outside corner structure 64 and the wall 50. And though not shown, the inside and outside corner structures 62, 64 may include a single planar wall bridging separate panel structures and extending over the respective corner.

Figure 7:
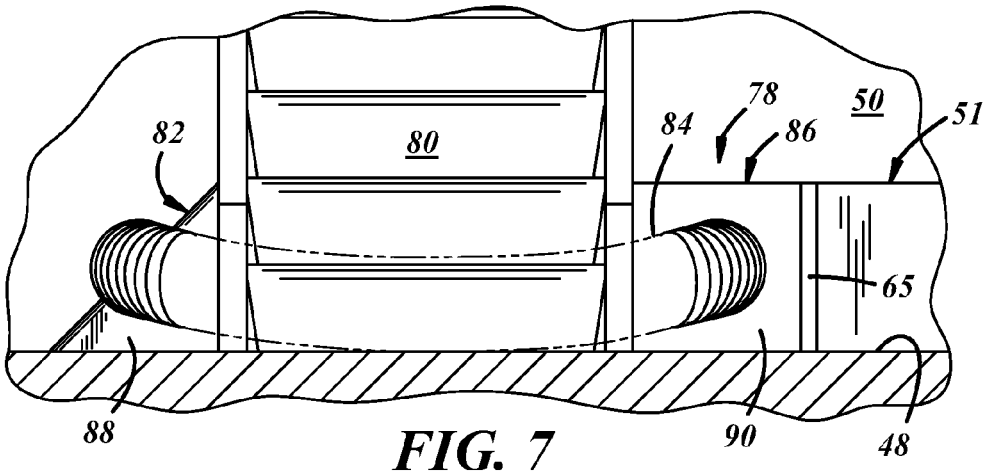
FIG. 7 is a perspective view of an illustrative embodiment of a diverting assembly that may be used in the wall restoration system of FIG. 1.

Referring to FIG. 7, the wall structure assembly 14 may also include a diverting assembly 78. In one embodiment, the diverting assembly 78 may be used to route air around a structure such as a staircase 80. In the illustrated embodiment, the diverting assembly 78 may include a first inlet or outlet structure 82, a fourth duct 84 (shown partially in phantom), and a second inlet or outlet structure 86. The first structure 82 may resemble the inlet structure 42 of FIG. 3. The first structure 82 may have an opening directly communicating with the fourth duct 84, and may have a side wall 88, a top wall, and an open end. In one embodiment, an H-channel may be fitted between confronting edges of the first structure 82 and a panel structure (not shown), and seals such as painter's tape may be used similarly as described. The fourth duct 84 may be directly connected to the first and second structures 82, 86. The fourth duct 84 may have a 6 inch diameter, for example. The second structure 86 may resemble a shortened panel structure with an opening therein directly communicating with the fourth duct 84. The second structure 86 may have a single planar wall 90 that may rest against and contact the floor 48 and the wall 50, and may form an angle of about 45° with respect to the floor. In one embodiment, an H-channel may be fitted between confronting edges of the second structure and a panel structure 51, and a seal such as a piece 65 of painter's tape may be placed over a seam thereat. In use, air can flow from the first structure 82, through the fourth duct 84, and to the second structure 86; or air can flow from the second structure, through the fourth duct, and to the first structure; the direction of airflow may depend on the direction that the forced and/or pressurized air is coming from.

Figure 8:
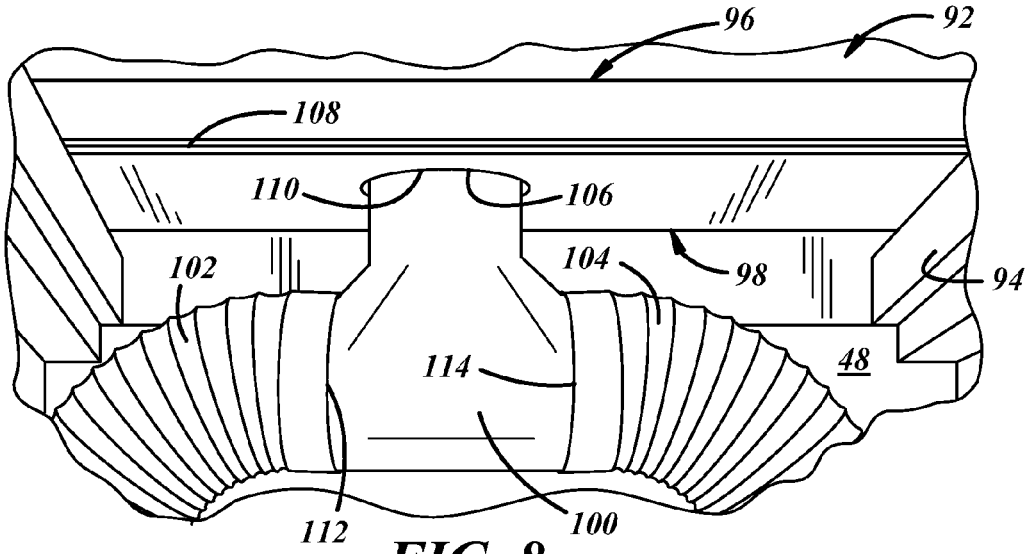
FIG. 8 is a perspective view of an illustrative embodiment of a distributing assembly that may be used in the wall restoration system of FIG. 1.

Referring to FIG. 8, the wall structure assembly 14 may also include a distributing assembly 92. In one embodiment, the distributing assembly 92 may be used to route air past a doorway 94 and/or to route air between different rooms, or to route air to a separate and distinct wall structure assembly as will be subsequently described. In the illustrated embodiment, the distributing assembly 92 may include a first panel structure 96, a second panel structure 98, a connector 100, and a fifth and sixth duct 102, 104. The first panel structure 96 may be similar to the panel structure 44 previously described. The second panel structure 98 may too be similar to the panel structure 44. The second panel structure 98 may have a longest dimension (i.e., horizontal length) greater than a width of the doorway 94, and may have an opening 106 formed therein. The second panel structure 98 may be positioned vertical, and the first panel structure 96 may rest against the second panel structure at a top edge 108 thereof and may form a 45° angle with respect to the floor 48. A seal such as a piece (not shown) of painter's tape may be placed over a seam formed at the top edge 108. The first and second panel structures 96, 98 may in part form the passage 60 through which air may flow during use.

In one embodiment, the connector 100 may be directly connected to, and may communicate with, the opening 106 to receive airflow through the opening. The connector 100 may take many forms including a T-connector as shown. The T-connector may be made out of a galvanized sheet metal, or another suitable material, for example, and may have an inlet 110, and a first and second outlet 112, 114. The fifth and sixth ducts 102, 104 may respectively be directly connected to, and may communicate with, the first and second outlets 112, 114. The fifth and sixth ducts 102, 104 may have 6 inch diameters, for example. In use, air can flow through the passage 60 formed between structures 96, 98 and from one side of the doorway 94 to the other. Air can also flow through the connector 100 and through the fifth and sixth ducts 102, 104. The fifth and sixth ducts 102, 104 may communicate with other wall structure assemblies at their ends away from the connector 100.

Figure 9:
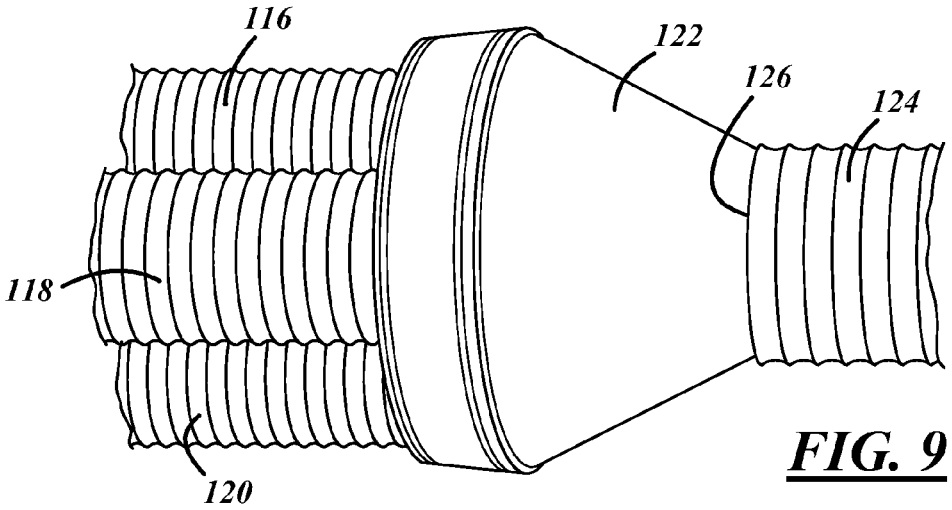
FIG. 9 is a perspective view of an illustrative embodiment of a multi-return manifold that may be used in the wall restoration system of FIG. 1.

Referring to FIG. 9, in the illustrated embodiment the ductwork assembly 22 may also include a seventh, eighth, and ninth duct 116, 118, 120, a multi-return manifold 122, and a return duct 124. The ducts 116, 118, 120 may carry airflow from separate locations in the wall structure assembly 14, or from separate wall structure assemblies. The ducts 116, 118, 120 may have 6 or 4 inch diameters, for example. The multi-return manifold 122 may receive incoming air from the ducts 116, 118, 120, and may direct the air to the return duct 124. The multi-return manifold 122 may be made out of a galvanized sheet metal, or another suitable material, for example, and may have a first, second, and third inlet and a single outlet 126. The return duct 124 may be directly connected to and may communicate with the outlet 126. The return duct 124 may have a 12 or 6 inch diameter, for example.

In one embodiment, the dehumidifier 16 may directly communicate with the return duct 124, and may reduce the humidity level of the received airflow (i.e., removes moisture out of air). For example, the entering air may have about 50% or more humidity, and the exiting air may have about one-half the humidity of the entering air (e.g., 25%). Of course, the humidity of the exiting air may depend on the performance capabilities of the particular dehumidifier. Referring to FIG. 1, the dehumidifier 16 may have an intake or inlet 128 (e.g., 12 inch diameter), a supply or outlet 130 (e.g., 12 inch diameter), and may have an internal vacuum that draws air into the inlet. In one example, the dehumidifier 16 may be a Phoenix 200 MAX LGR dehumidifier sold by Therma-Stor LLC. Of course, other dehumidifiers of different types, constructions, specifications, performances, and manufacturers are possible.

If needed, multiple weights such as 5-10 lb sandbags (not shown) may be placed at various locations of the wall structure assembly 14 to help keep the pieces of the assembly in place against the pressurized and fast-moving airflow. For example, a sandbag may be placed partly on the floor 48 and partly against the panel structure 44.

In one embodiment, the wall restoration system 10 may be a semi-closed system. In a first example, air may exit the seventh, eighth, and/or ninth ducts 116, 118, 120 into the associated room. This example need not have the multi-return manifold 122 and the return duct 124. Instead, the dehumidifier 16 may draw-in air from the associated room and may communicate resultantly drier air to the air-handler 12 via an intermediate duct 132 (FIG. 1) of the ductwork assembly 22. Then in this example, in use, air may flow from the dehumidifier 16, through the intermediate duct 132, through the air-handler 12, through the ductwork assembly 22, through one or more wall structure assemblies, and into the associated room. In a second similar example, air may exit the seventh, eighth, and/or ninth ducts 116, 118, 120 and out the associated room through a window, door, or the like. Again here, the inlet 128 of the dehumidifier 16 may simply draw-in air from the associated room.

In another embodiment, the wall restoration system 10 may be a completely closed system in which air continuously and repeatedly cycles and recirculates through the wall restoration system (i.e., substantially the same air is reused through the system). Here, the dehumidifier 16 and the air-handler 12 may communicate and exchange air with each other via the intermediate duct 132. In use, air may flow from the air-handler 12, through the ductwork assembly 22, through one or more wall structure assemblies 14, through the ductwork assembly again, through the dehumidifier 16, through the intermediate duct 132, and back to the air-handler.

In select embodiments of both the semi-closed and completely closed embodiments, only a single energy source may be needed such as a single air-handler 12 and/or a single dehumidifier 16. Of course, in either case, more than a single air-handler 12 and/or single dehumidifier 16 may be provided.

In different embodiments, separate and distinct wall structure assemblies may be used. For example, the first duct 28 may direct airflow from the air-handler 12 to a first wall structure assembly, the second duct 30 may direct airflow from the air-handler to a second wall structure assembly, and the third duct 32 may direct airflow from the air-handler to a third wall structure assembly. The first wall structure assembly may enclose a portion of a wet wall and floor of a residential basement, and may guide air to the dehumidifier 16 and back to the air-handler 12 via the ductwork assembly 22. The second wall structure assembly may enclose a portion of a different wet wall and floor of a first residential floor that is directly above the basement, and may guide air to the dehumidifier 16 and back to the air-handler 12 via the ductwork assembly 22. The third wall structure assembly may enclose a portion of a cabinet assembly (e.g., basement wet bar) which may require a lower-profile wall structure assembly such as a 4 inch enclosure structure; of course, in this instance the third wall structure would have pieces adapted and constructed for such a lower-profile set-up and arrangement. In another example, the first wall structure assembly may enclose a portion of a wet wall of a media room, while the second wall structure assembly may enclose a portion of a wet wall of a bathroom—the media room and bathroom being on the same floor. In this way, different rooms and/or different floors can be simultaneously serviced by the wall restoration system 10.

It should be appreciated that the wall restoration system 10 can have various set-ups and arrangements other than that shown and described. The exact set-up and arrangement may depend on, among other things, the magnitude of the flood, the layout of the residential or commercial space, and the like. Consequently, more, less, and/or different components, structures, and pieces may be used other than those shown and described. For example, a less complex ductwork assembly with fewer ducts may be used for a smaller area.

In one embodiment, the wall restoration system 10 may be used to dry a wet wall portion without having to drill holes into the base of the wall portion (e.g., drywall) and without using tubes inserted into the wall portion. The wall restoration system 10 can be used to dry the wall portion and any associated insulation, substrates, and/or other interior structures that may have become wet. Here, airflow (heated or not) passes though the passage 60 and over the exposed and external wall and floor portions 58, 60, which may draw moisture from interior structures and into the passage. When an electric heater is used, the entire wall restoration system 10 can be located in a closed home or commercial building.

In one embodiment, the wall restoration system 10 may be used after a relatively severe flood to dry wet insulation, substrates, and/or other structures located in the interior of the wet wall. For example, 1 inch diameter openings may be cut in the base of the wall and may be spaced 6 inches from one another. The wall structure assembly 14 may then be placed over the openings and may enclose the openings. In use, the passage 60 may communicate with the openings and airflow may pass through the openings to the interior of the wall.

In one embodiment, the wall restoration system 10 may be used to dry exposed wall studs and other structures located in the interior of the wet wall after the wall, studs, and other structures have been flooded by sewage water (i.e., a so-called class 3 water intrusion). In one example of this case, a vertical portion of the wall from the floor up may be removed (e.g., 2 feet), leaving the interior of the wall exposed. The wall structure assembly 14 may be constructed and adapted to enclose the exposed structures of the wall. For example, the panel structure 44 may rest against the vertically extending wall studs; a cover such as a foam like a polyurethane foam or an expanded polystyrene (EPS) foam may be used to seal the otherwise open top formed between the panel structure and the wall studs; the cover may be constructed to fit around the wall studs by cutting slits in the cover to receive the studs therein; the enclosed passage 60 may thus be formed in part between the panel structure, the wall studs and other structures, and the cover. Air may then travel through the passage 60 to dry the exposed wall studs and other structures located in the interior of the wet wall.

The above description of embodiments of the invention is merely exemplary in nature and, thus, variations thereof are not to be regarded as a departure from the spirit and scope of the invention.

What is claimed is:

1. A wall restoration system, comprising:

an air-handler having an outlet and providing forced-air movement through the outlet;

a supply duct communicating with the outlet and receiving the forced-air movement; and a wall structure assembly communicating with the supply duct and including a panel structure enclosing a portion of an outer surface of a wall over a horizontal length of the wall and enclosing a portion of a floor adjacent the wall over a horizontal length of the floor in order to form a passage for the forced-air movement;

a dehumidifier communicating with a return duct which communicates with the wall structure assembly; and an intermediate duct communicating with the dehumidifier and with the air-handler;

wherein the wall restoration system is a closed system in which the forced-air movement continuously recirculates from the air-handler, to the supply duct, to the wall structure assembly, to the return duct, to the dehumidifier, to the intermediate duct, and back to the air-handler, and wherein the wall and floor portions enclosed remain unaltered without holes or other openings formed therein at their respective horizontal lengths for the wall restoration system.

2. A wall restoration system as set forth in claim 1 wherein the air-handler comprises a heater.

3. A wall restoration system as set forth in claim 1 wherein the panel structure makes direct contact with both the floor and the wall, and wherein the passage is a non-divided and single space formed via the panel structure, the wall, and the floor.

4. A wall restoration system as set forth in claim 1 wherein the wall structure assembly comprises:

an inside corner structure having at least one planar wall enclosing a portion of a wall and of a floor adjacent an inside corner of the wall in order to form a second passage for the forced-air movement over the inside corner; and an outside corner structure having at least one planar wall enclosing a portion of a wall and of a floor adjacent an outside corner of the wall in order to form a third passage for the forced-air movement over the outside corner.

5. A wall restoration system as set forth in claim 1 wherein the wall structure assembly comprises a diverting assembly to route the forced-air movement passed a staircase, the diverting assembly including an inlet structure, a duct, and an outlet structure.

6. A wall restoration system as set forth in claim 1 wherein the wall structure assembly comprises a distributing assembly to route the forced-air movement passed a doorway, the distributing assembly including at least one panel structure.

7. A wall restoration system as set forth in claim 1 wherein the horizontal length of the wall and the floor measures at least four feet.

8. A wall restoration system as set forth in claim 1 further comprising a supply manifold communicating with the supply duct and having at least a pair of ducts receiving the forced air movement from the supply duct.

9. A wall restoration system as set forth in claim 8 wherein one of the pair of ducts communicates with the passage of the panel structure, wall, and floor.

10. A wall restoration system as set forth in claim 8 further comprising a multi-return manifold communicating with and receiving incoming forced-air movement from at least a second pair of ducts, the multi-return manifold directing the incoming forced-air movement to a single return duct.

* * * * *